US010566728B1

(12) United States Patent
Sundarakrishnamachari et al.

(10) Patent No.: US 10,566,728 B1
(45) Date of Patent: Feb. 18, 2020

(54) ELECTRICAL CONNECTOR WITH HIGH VIBRATION RESISTANT LOCKS

(71) Applicant: Aptiv Technologies Limited, St. Michael (BB)

(72) Inventors: Rangarajan Sundarakrishnamachari, Royapettah (IN); Sivakumar Niranjan, Nagarkurnool (IN); Bart Caldwell, West Farmington, OH (US)

(73) Assignee: Aptiv Technologies Limited (BB)

( * ) Notice: Subject to any disclaimer, the term of this patent is extended or adjusted under 35 U.S.C. 154(b) by 0 days.

(21) Appl. No.: 16/174,359

(22) Filed: Oct. 30, 2018

(51) Int. Cl.
*H01R 13/436* (2006.01)
*H01R 13/533* (2006.01)
*H01R 13/639* (2006.01)

(52) U.S. Cl.
CPC ..... *H01R 13/436* (2013.01); *H01R 13/533* (2013.01); *H01R 13/639* (2013.01)

(58) Field of Classification Search
CPC ..... H01R 13/4362; H01R 13/4361; H01R 13/62938; H01R 13/62933; H01R 13/62944; H01R 13/62955; H01R 13/639; H01R 13/4223; H01R 13/4365; H01R 13/436; H01R 13/533
USPC ..... 439/372, 157, 752, 595
See application file for complete search history.

(56) References Cited

U.S. PATENT DOCUMENTS 4,376,563 A * 3/1983 Margrave ..... H01R 13/627 439/358
5,403,211 A * 4/1995 Sayer ..... H01R 13/4362 439/603
5,833,484 A * 11/1998 Post ..... H01R 13/62955 439/352
5,928,038 A * 7/1999 Berg ..... H01R 13/6272 439/489
5,934,926 A * 8/1999 Gabrisko, Jr. ..... H01R 13/6215 439/357
5,954,546 A * 9/1999 Fink ..... H01R 13/4361 439/595
6,004,158 A * 12/1999 Ward ..... H01R 13/4361 439/595

(Continued)

*Primary Examiner* — Gary F Paumen
(74) *Attorney, Agent, or Firm* — Robert J. Myers

(57) ABSTRACT

An electrical connector-assembly includes a first-housing and a second-housing. The first-housing has first-walls that include opposed gear-racks extending beyond an outer-surface. The opposed gear-racks are configured to engage a mate-assist device. The first-walls include opposed locking-fins extending beyond the outer-surface. The opposed locking-fins have first-fins and second-fins. The second-housing includes the mate-assist device which is moveable from an unlocked-position to a locked-position and is pivotable about the lateral-axis. The mate-assist device has gear-teeth configured to engage the opposed gear-racks of the first-housing. The second-housing has a skirt configured to slideably engage the outer-surface of the first-housing. The skirt includes flex-locks configured to engage the first-fins and retain the second-housing in a prestage-position. When the mate-assist device is moved from the unlocked-position to the locked-position, the second-housing is moved from the prestage-position to a seated-position, whereby the flex-locks engage the second-fins, thereby inhibiting a movement between the second-housing and the first-housing.

15 Claims, 9 Drawing Sheets

(56) References Cited

U.S. PATENT DOCUMENTS 6,514,099 B2 * 2/2003 Endo ..... H01R 13/641 439/357
6,739,889 B1 * 5/2004 Daggett ..... H01R 13/62938 439/157
7,597,578 B2 * 10/2009 Adunka ..... H02B 1/056 200/295
8,784,127 B2 * 7/2014 Bashkin ..... H01R 13/62955 439/372
9,843,126 B1 * 12/2017 Irish ..... H01R 13/4362
2001/0016457 A1 * 8/2001 Taguchi ..... H01R 13/4361 439/752
2003/0008557 A1 * 1/2003 Suzuki ..... H01R 13/4362 439/595
2006/0040536 A1 * 2/2006 Putnam ..... H01R 13/62977 439/157
2009/0246992 A1 * 10/2009 Martin ..... H01R 13/62944 439/157
2010/0178791 A1 * 7/2010 Komiyama ..... H01R 13/4361 439/347
2012/0196465 A1 * 8/2012 Stausser ..... H01R 13/4362 439/282
2012/0329299 A1 * 12/2012 Kitajima ..... H01R 12/716 439/147
2014/0065865 A1 * 3/2014 Mizutani ..... H01R 13/4365 439/271
2014/0134862 A1 * 5/2014 Itou ..... H01R 13/62944 439/157
2014/0273566 A1 * 9/2014 Allgood ..... H01R 13/516 439/157
2015/0140847 A1 * 5/2015 Kanemura ..... H01R 13/4368 439/259
2016/0141790 A1 * 5/2016 Martin ..... H01R 9/24 439/712
2016/0254618 A1 * 9/2016 Ludwig ..... H01R 13/62938 439/372
2017/0288334 A1 * 10/2017 Moriyasu ..... H01R 13/521
2017/0365950 A1 * 12/2017 Matsuura ..... H01R 13/4362

* cited by examiner

ELECTRICAL CONNECTOR WITH HIGH VIBRATION RESISTANT LOCKS

TECHNICAL FIELD OF INVENTION

This disclosure generally relates to an electrical connector, and more particularly relates to an electrical connector with a high vibration resistant locking mechanism.

BRIEF DESCRIPTION OF DRAWINGS

The present invention will now be described, by way of example with reference to the accompanying drawings, in which.

DETAILED DESCRIPTION

Reference will now be made in detail to embodiments, examples of which are illustrated in the accompanying drawings. In the following detailed description, numerous specific details are set forth in order to provide a thorough understanding of the various described embodiments. However, it will be apparent to one of ordinary skill in the art that the various described embodiments may be practiced without these specific details. In other instances, well-known methods, procedures, components, circuits, and networks have not been described in detail so as not to unnecessarily obscure aspects of the embodiments.

Figure 1A:
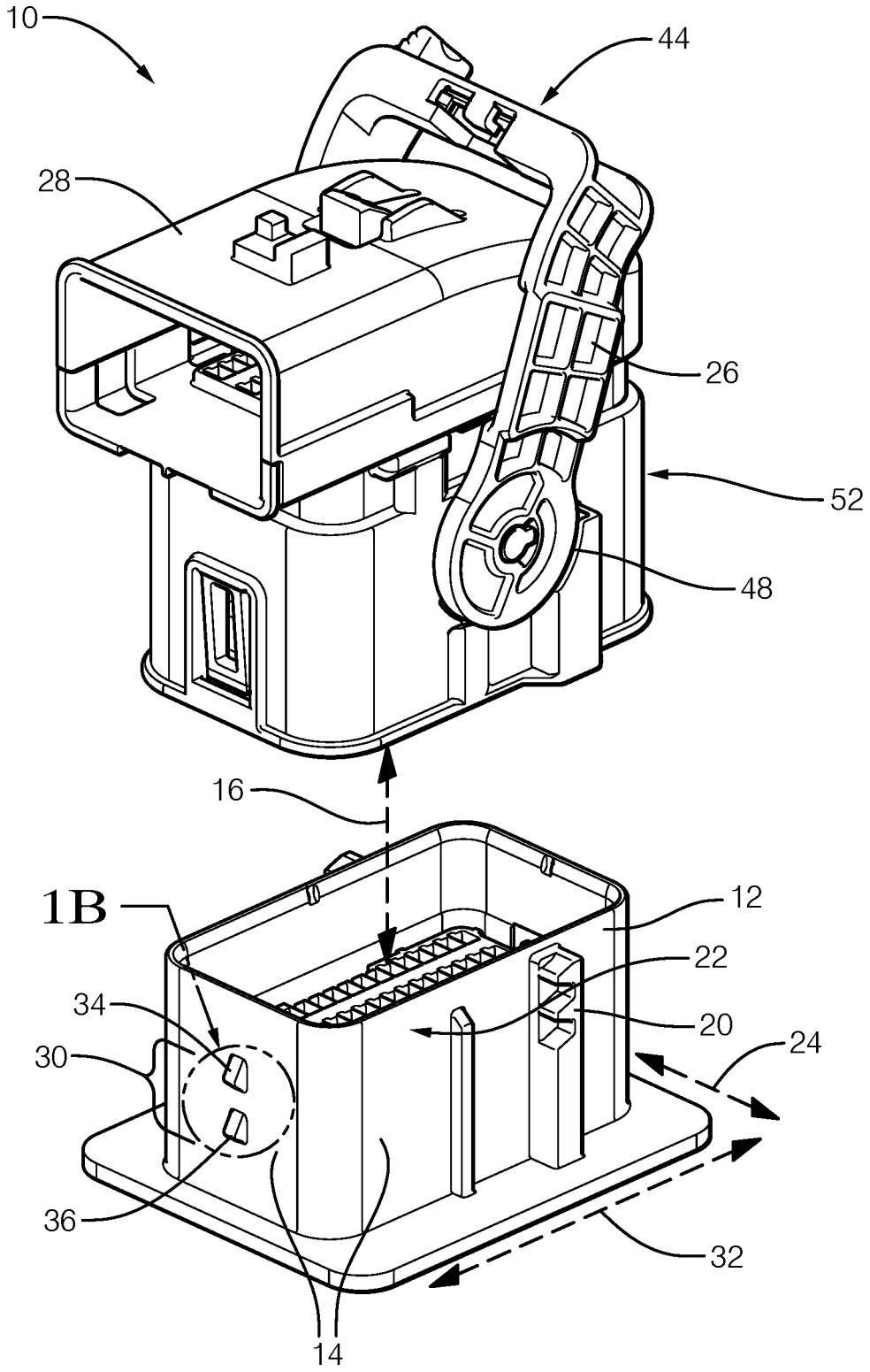
FIG. 1A is an exploded perspective view of an illustration of an electrical-connector assembly in accordance with one embodiment.

FIG. 1A is a perspective exploded view illustrating an electrical connector-assembly 10, hereafter referred to as the assembly 10. As will be described in more detail below, the assembly 10 is an improvement over other connector assemblies, because the assembly 10 resists high vibrations by limiting a movement between connector housings.

The assembly 10 includes a first-housing 12 that has first-walls 14 aligned parallel to a mating-axis 16 of the assembly 10. The first-housing 12 is formed of a polymeric dielectric material. The polymeric dielectric material may be any polymeric dielectric material capable of electrically isolating portions of electrical-terminals 18 (see FIG. 4) retained by the first-housing 12, and is preferably a polyamide (NYLON) material. The first-walls 14 include opposed gear-racks 20 extending beyond an outer-surface 22 of the first-walls 14 along a lateral-axis 24 and aligned with the mating-axis 16. The opposed gear-racks 20 are configured to engage a mate-assist device 26 mounted on a second-housing 28, as will be described in more detail below.

Figure 1B:
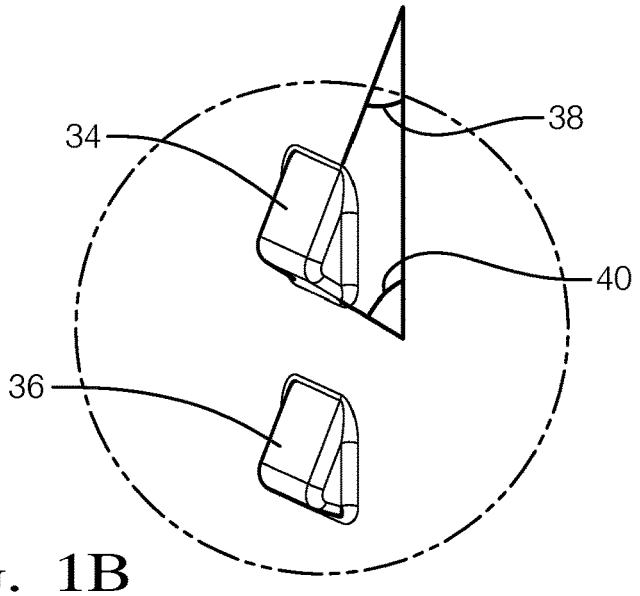
FIG. 1B is a close-up view of a portion of the electrical-connector assembly of FIG. 1A in accordance with one embodiment.

The first-walls 14 include opposed locking-fins 30, hereafter referred to as the locking-fins 30, extending along a longitudinal-axis 32 beyond the outer-surface 22 and are aligned with the mating-axis 16. The locking-fins 30 have first-fins 34 and second-fins 36 aligned with the mating-axis 16, with the first-fin 34 positioned superior to (i.e. above, distal to, etc.) the second-fin 36, as illustrated in FIGS. 1A-1B. In one embodiment the first-housing 12 includes a single pair of opposed first-fin 34 and second-fin 36 pairs. In the example illustrated in FIG. 1, the first-housing 12 further includes a plurality of opposed first-fin 34 and second-fin 36 pairs that are located on opposite sides of the first-housing 12 from one another. The first-fins 34 and the second-fins 36 define first-angles 38 and second-angles 40 (see FIG. 1B), with the first-angles 38 less than the second-angles 40, the function of which will be described in more detail below. Preferably, the first-angles 38 are in a range between 15-degrees and 30-degrees, and the second-angles 40 are in the range between 30-degrees and 60-degrees.

Figure 3:
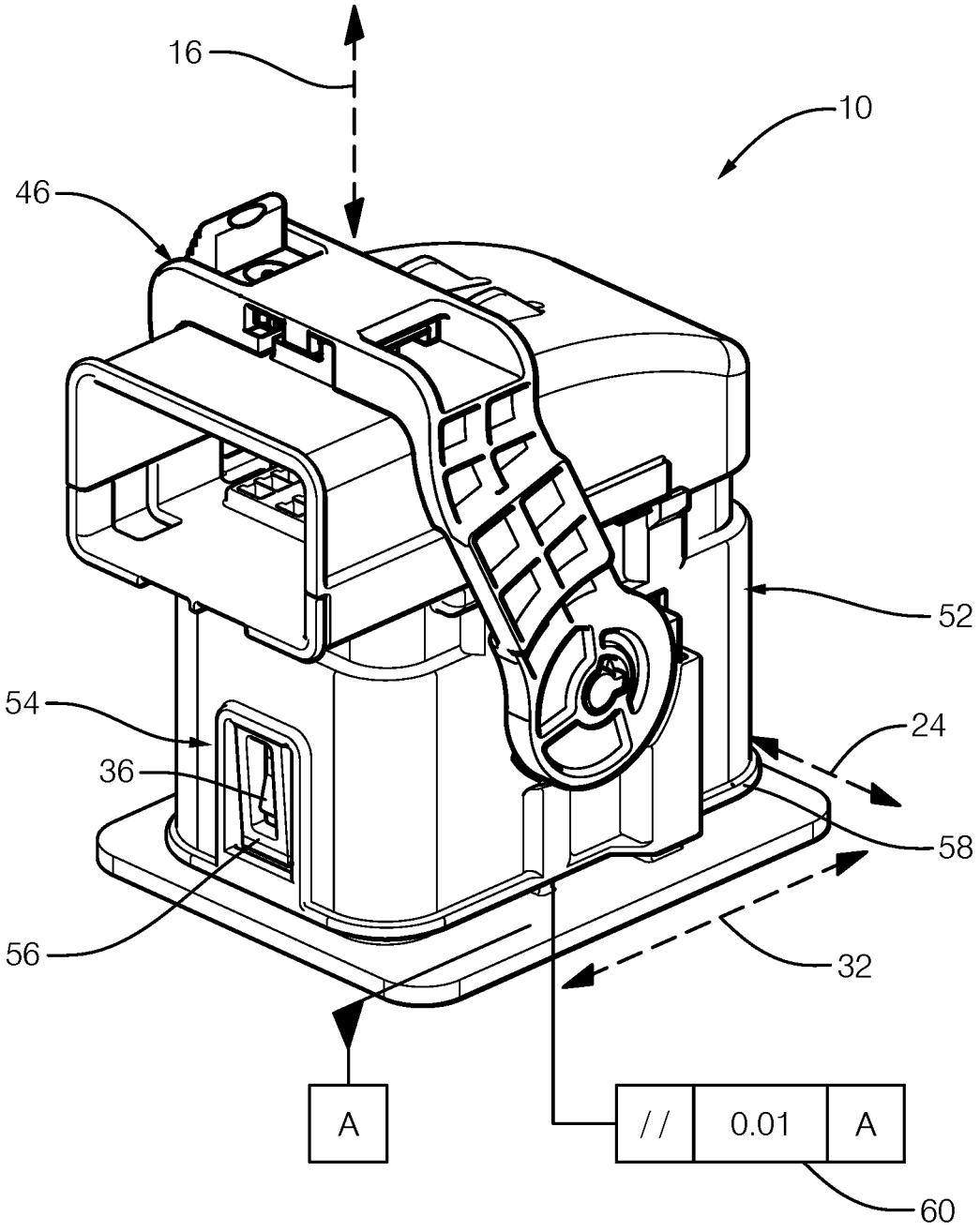
FIG. 3 is an illustration of the electrical-connector assembly of FIG. 1 in a seated-position in accordance with one embodiment.
Figure 4:
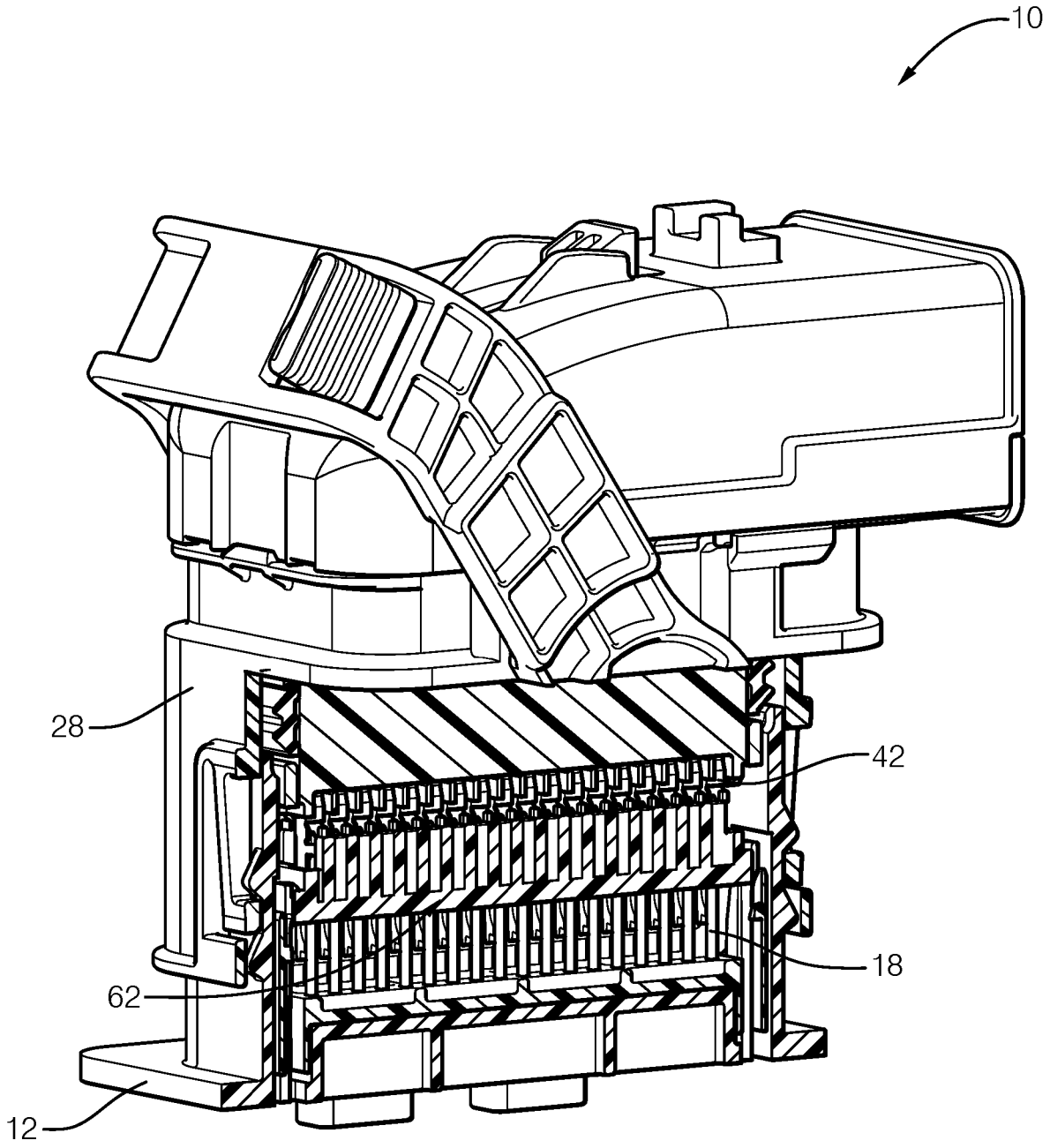
FIG. 4 is a section view of the electrical-connector assembly of FIG. 2 in accordance with one embodiment.

The assembly 10 also includes the second-housing 28 configured to retain corresponding electrical-terminals 42 that are configured to mate with the electrical-terminals 18 of the first-housing 12 (see FIG. 4). The second-housing 28 is preferably formed of the same polymeric dielectric material as the first-housing 12, but may be any polymeric dielectric material. The second-housing 28 includes the mate-assist device 26 which is moveable from an unlocked-position 44 to a locked-position 46 (see FIG. 3). In the example illustrated in FIG. 1, the mate-assist device 26 is in the unlocked-position 44. The mate-assist device 26 is pivotable about the lateral-axis 24 and includes gear-teeth 48 configured to engage the opposed gear-racks 20 of the first-housing 12. The mate-assist device 26 reversibly locks in the locked-position 46 to a locking-lug extending from a wire dress cover (not specifically shown) that forms the top of the second-housing 28.

Figure 2:
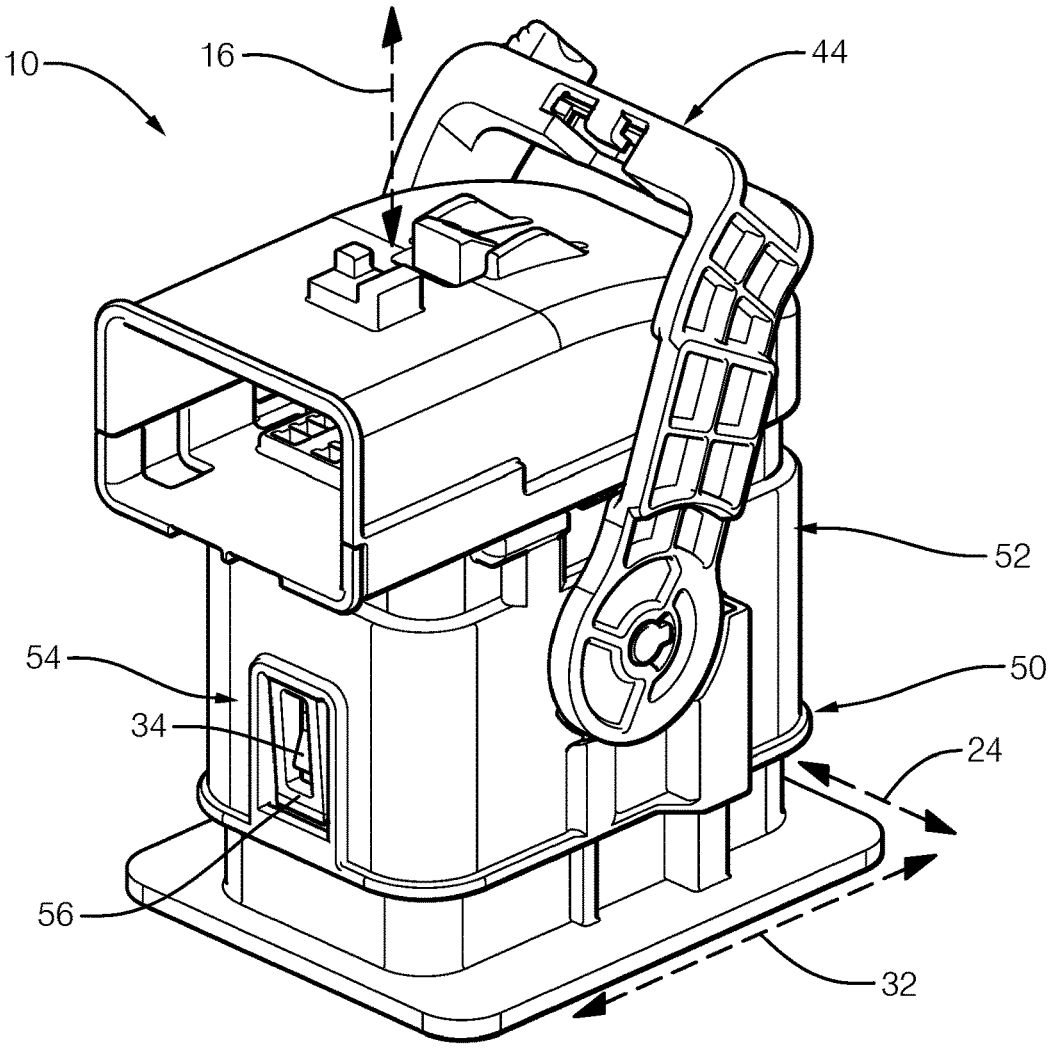
FIG. 2 is an illustration of the electrical-connector assembly of FIG. 1 in a prestage-position in accordance with one embodiment.

FIG. 2 illustrates the assembly 10 in a prestage-position 50. The second-housing 28 has a skirt 52 aligned with (i.e. parallel to) the mating-axis 16. The skirt 52 is configured to slideably engage the outer-surface 22 of the first-housing 12 when the second-housing 28 is mated with the first-housing 12. The skirt 52 defines opposed-apertures 54 aligned with the longitudinal-axis 32 into which are disposed flex-locks 56 that extend along the mating-axis 16. The flex-locks 56 are configured to engage the first-fins 34 on the first-housing 12 and retain the second-housing 28 in the prestage-position 50. That is, the flex-locks 56 slide along the first-angles 38 of the first-fins 34 and engage the greater inclined second-angles 40 of the first-fins 34 when the assembly 10 is placed in the prestage-position 50. The flex-locks 56 are configured to resist a rotational-moment of the second-housing 28 about the lateral-axis 24 that may be caused by a weight of wire-cables (e.g., a wiring-harness—not shown) exiting the wire dress cover. In the examples illustrated in FIGS. 1A and 2, the skirt 52 includes a plurality of corresponding flex-locks 56 that engage the plurality of opposed first-fin 34 and second-fin 36 pairs that are located on opposite sides of the first-housing 12. A force of between about 10-Newtons and about 15-Newtons is required to remove the second-housing 28 from the first-housing 12 when the second-housing 28 is in the prestage-position 50. Experimentation by the inventors has discovered that the force in this range is sufficient to resist an equivalent rotational-force applied by a 1-meter length of wiring-harness. This has the technical benefit of maintaining the second-housing 28 in the prestage-position 50 during an installation of the wiring-harness and inhibiting an unintentional removal, while meeting ergonomic requirements for an intentional removal by an assembler.

FIG. 3 illustrates the assembly 10 in a seated-position 58. When the mate-assist device 26 is moved from the unlocked-position 44 to the locked-position 46, the gear-teeth 48 engage the gear-racks 20 of the first-housing 12 and move the second-housing 28 from the prestage-position 50 to the seated-position 58. The flex-locks 56 move beyond the second-angles 40 of the first-fins 34 and ultimately engage the second-angles 40 of the second-fins 36, thereby inhibiting a movement between the second-housing 28 and the first-housing 12. In the seated-position 58 a parallelism 60 between the first-housing 12 and the second-housing 28 relative to a plane parallel with the longitudinal-axis 32 (denoted by Datum "A" in FIG. 3) is less than 0.01-mm when the flex-locks 56 engage the second-fins 36. The parallelism 60 has the technical benefit of maintaining a proper alignment between the electrical-terminals 18 and the corresponding electrical-terminals 42 for electrical circuit continuity, as well as maintaining the proper alignment between the first-housing 12 and the second-housing 28 for optimum sealing of the assembly 10.

FIG. 4 is a cut-away perspective view of the assembly 10 in the prestage-position 50 illustrating internal components of the assembly 10. The second-housing 28 further includes an inner-housing-assembly 62 that retains the corresponding electrical-terminals 42.

Figure 5A:
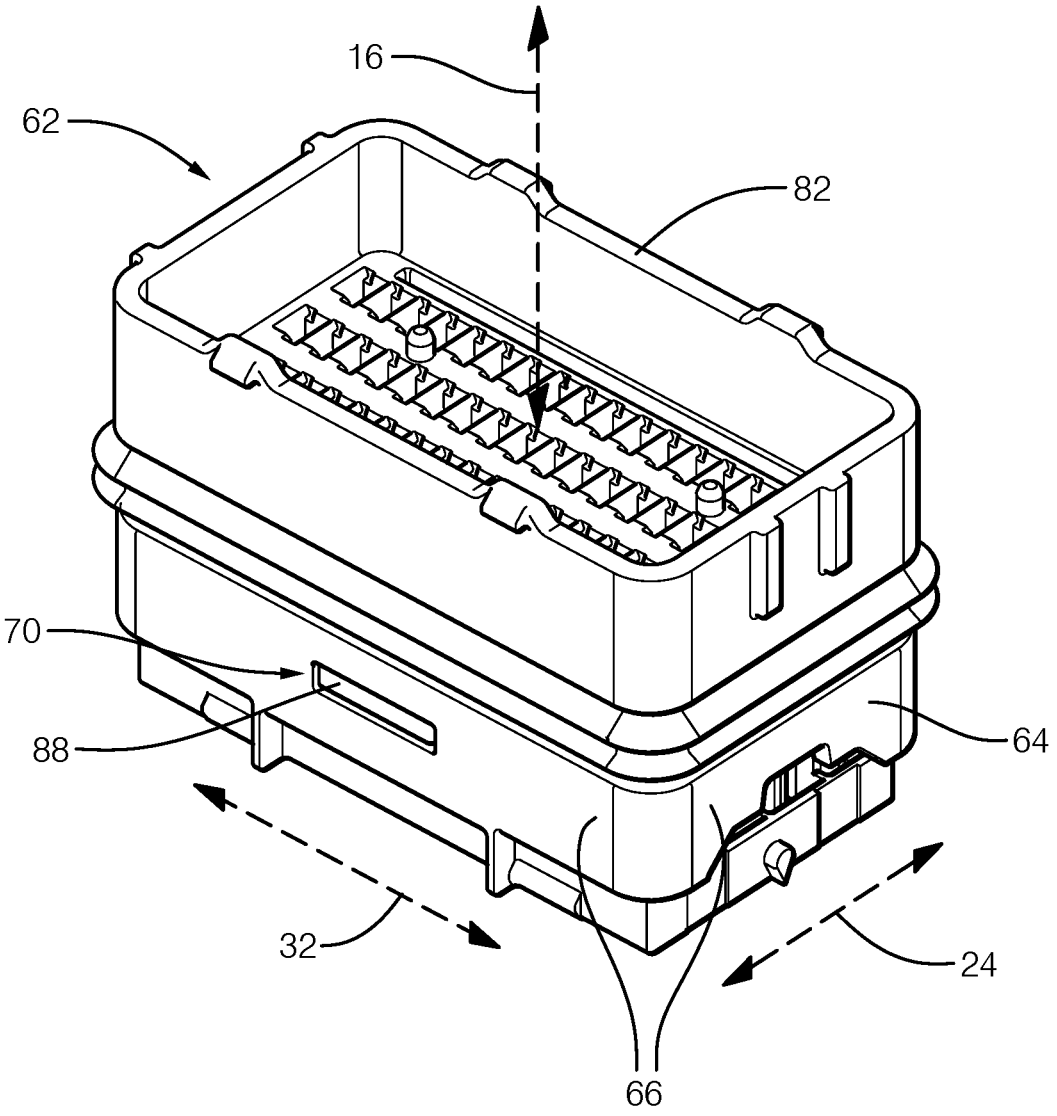
FIG. 5A is an illustration of an inner-housing-assembly isolated from the electrical-connector assembly of FIG. 1 in accordance with one embodiment.
Figure 5B:
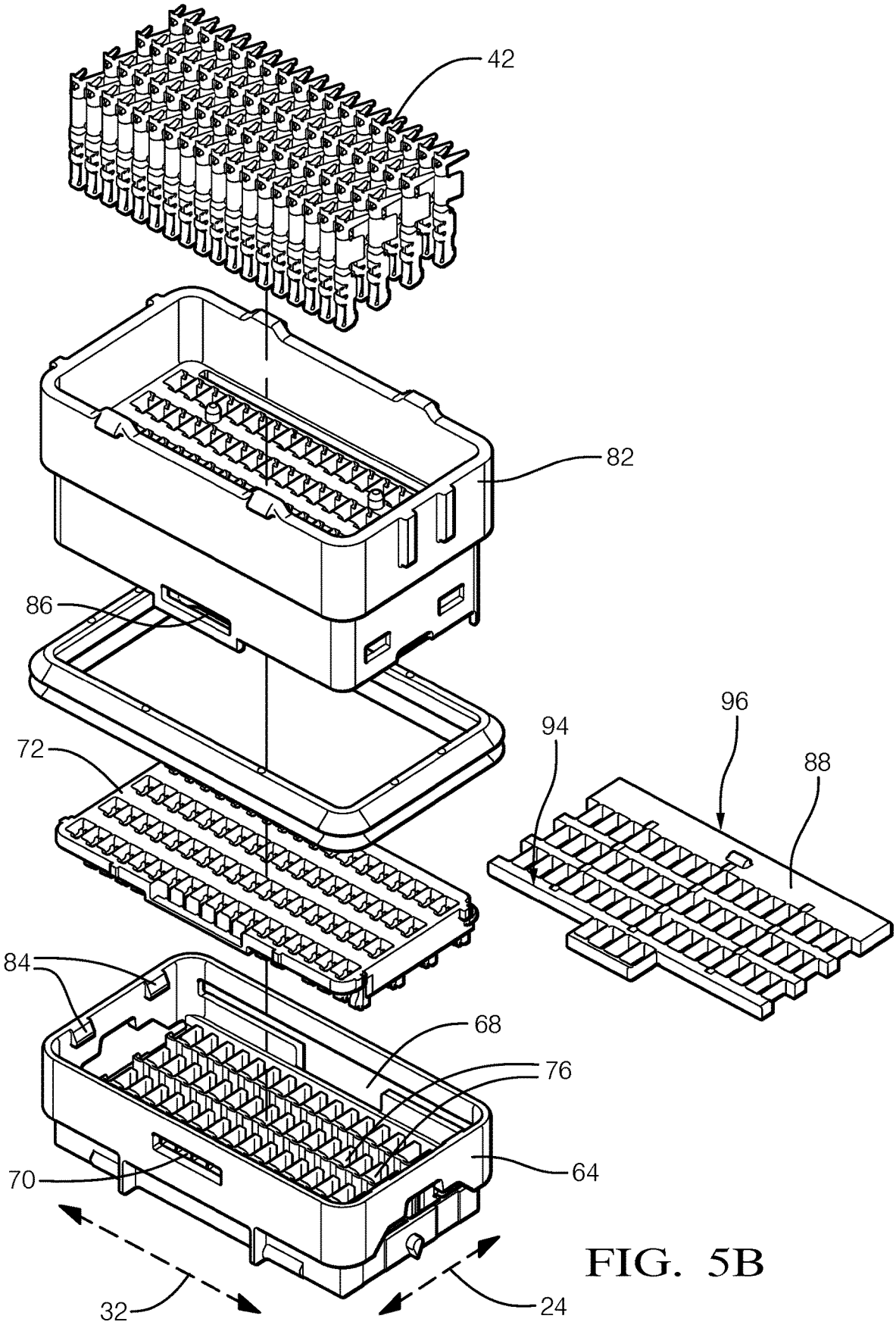
FIG. 5B is an exploded view of the inner-housing-assembly of FIG. 5A in accordance with one embodiment.

FIGS. 5A-5B illustrate the inner-housing-assembly 62 isolated from the assembly 10. The inner-housing-assembly 62 includes a base 64 configured to retain connector-ends (not specifically shown) of a plurality of the corresponding electrical-terminals 42 housed within the assembly 10. Preferably, a center-to-center spacing between the adjacent corresponding electrical-terminals 42 is about 2.2 mm, or less, to increase a terminal-density of the assembly 10. This spacing is a unique characteristic of the inner-housing-assembly 62 that is enabled by the structure, and would not otherwise be viably manufactured in a single-molded part. The base 64 includes second-walls 66 extending along the mating-axis 16 of the assembly 10 that define a first-slot 68 and a second-slot 70 opposite the first-slot 68. The first-slot 68 and the second-slot 70 extend along the longitudinal-axis 32 of the assembly 10, and the first-slot 68 has a length greater than the second-slot 70, the reason for which will be explained in more detail below.

Referring to FIG. 5B, the inner-housing-assembly 62 also includes a terminal-lock 72 overlaying the base 64 configured to releasably lock the plurality of corresponding electrical-terminals 42 within the base 64. The terminal-lock 72 includes a plurality of cantilevered locking-arms 74 (hereafter the locking-arms 74) configured to releasably lock the plurality of corresponding electrical-terminals 42 within the base 64.

Figure 6:
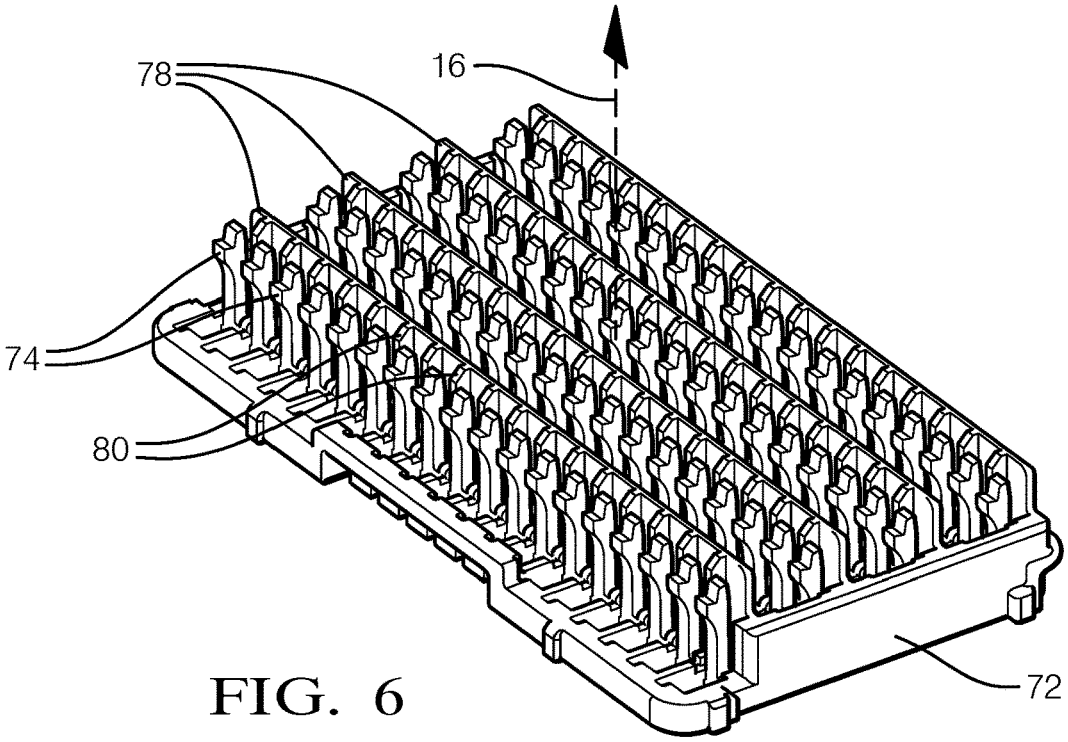
FIG. 6 is an illustration of a terminal-lock 72 isolated from the inner-housing-assembly of FIG. 5B in accordance with one embodiment.

FIG. 6 illustrates the terminal-lock 72 isolated from the inner-housing-assembly 62 and rotated 180-degrees to reveal the locking-arms 74 that are disposed within terminal-cavities 76 defined by the base 64. The locking-arms 74 are configured to extend along the mating-axis 16 into the terminal-cavities 76, and are adjacent to electrical-isolation-walls 78. The electrical-isolation-walls 78 inhibit an over-travel of the locking-arms 74 and further increase an electrical-isolation between the plurality of corresponding electrical-terminals 42. The electrical-isolation-walls 78 are supported by a plurality of buttresses 80 extending along the mating-axis 16 that are formed integral to the electrical-isolation-walls 78. The buttresses 80 are configured to increase a stiffness of the electrical-isolation-walls 78 to resist the overtravel of the locking-arms 74.

Referring back to FIG. 5B, the inner-housing-assembly 62 also includes a crimp-housing 82 configured to retain crimp-ends (not specifically shown) of the plurality of corresponding electrical-terminals 42 within crimp-cavities (not specifically shown) defined by the crimp-housing 82. The crimp-housing 82 overlays the terminal-lock 72 and is retained by a plurality of locking-fingers 84 extending inward from the second-walls 66 of the base 64. The plurality of locking-fingers 84 inhibit an unintentional disassembly of the inner-housing-assembly 62.

Figure 7:
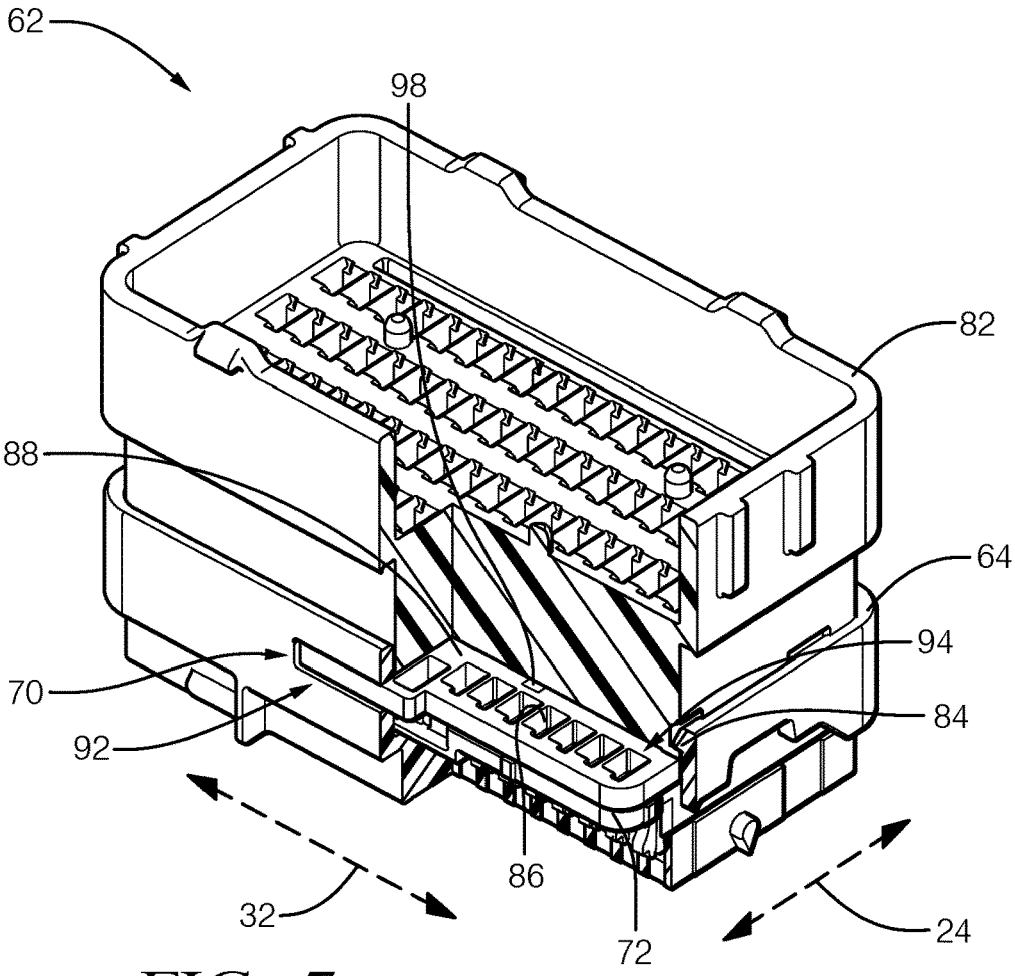
FIG. 7 is a section view of a portion of the of the inner-housing-assembly of FIG. 5A in accordance with one embodiment.

FIG. 7 is a section view of a portion of the inner-housing-assembly 62 with the plurality of corresponding electrical-terminals 42 removed. The crimp-housing 82 defines a passage 86 extending along both the lateral-axis 24 and the longitudinal-axis 32, and is disposed between the first-slot 68 and the second-slot 70 of the base 64. An intermediate-secondary-lock 88 (ISL 88) is slideably disposed within the passage 86. The ISL 88 is moveable from a first-position 90 (see FIG. 8A) to a second-position 92 (see FIG. 8B) along the lateral-axis 24, and is configured to inhibit the movement of the plurality of corresponding electrical-terminals 42 along the mating-axis 16 when moved to the second-position 92. It will be appreciated that when the ISL 88 is in the first-position 90, an assembler is able to insert the plurality of corresponding electrical-terminals 42 into the terminal-cavities 76. The ISL 88 has a leading-edge 94 and a trailing-edge 96 opposite the leading-edge 94. A plurality of pressure-pads 98 on the leading-edge 94 of the ISL 88 create a transition-fit when the ISL 88 is moved to the second-position 92, thereby inhibiting the movement between the base 64, the terminal-lock 72, and the crimp-housing 82. That is, the pressure-pads 98 create a wedge between the components of the inner-housing-assembly 62 and inhibit movement that may be caused by vibrations.

Figure 8A:
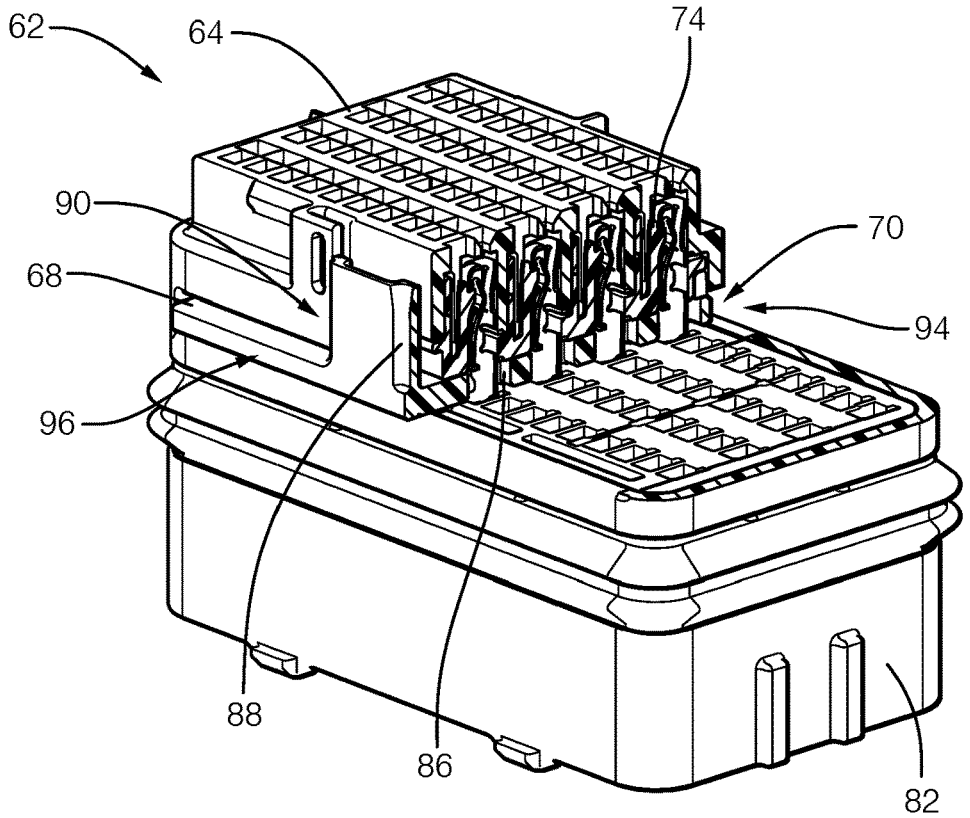
FIG. 8A is another section view of the inner-housing-assembly of FIG. 5A in accordance with one embodiment.
Figure 8B:
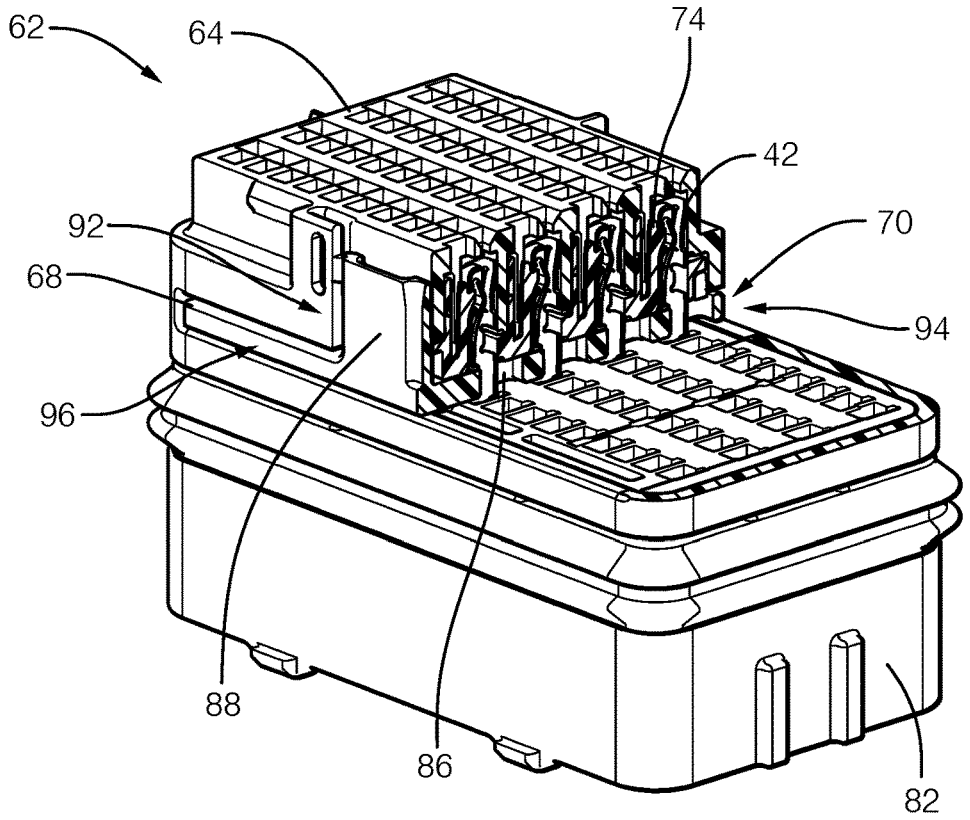
FIG. 8B is yet another section view of the inner-housing-assembly of FIG. 5A in accordance with one embodiment.

FIGS. 8A-8B are section views of the inner-housing-assembly 62 inverted and viewed from the opposite side relative to FIG. 7, and include the plurality of corresponding electrical-terminals 42. FIGS. 8A-8B illustrate the movement of the ISL 88 from the first-position 90 to the second-position 92. When the ISL 88 is in the first-position 90 (FIG. 8A), the trailing-edge 96 of the ISL 88 is disposed within the first-slot 68, however the leading-edge 94 of the ISL 88 is not disposed within the second-slot 70. When the ISL 88 is moved to the second-position 92 (FIG. 8B), a portion of the leading-edge 94 is disposed within the second-slot 70, thereby interlocking the base 64 with the crimp-housing 82 at both the first-slot 68 and the second-slot 70.

Figure 9A:
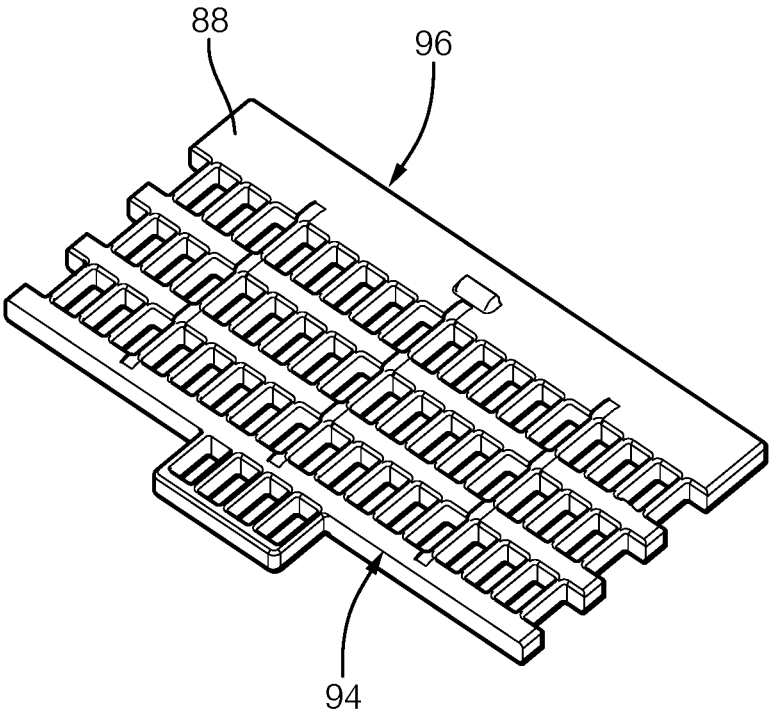
FIG. 9A is an illustration of an intermediate-secondary-lock isolated from the inner-housing-assembly of FIG. 5B in accordance with one embodiment.
Figure 9B:
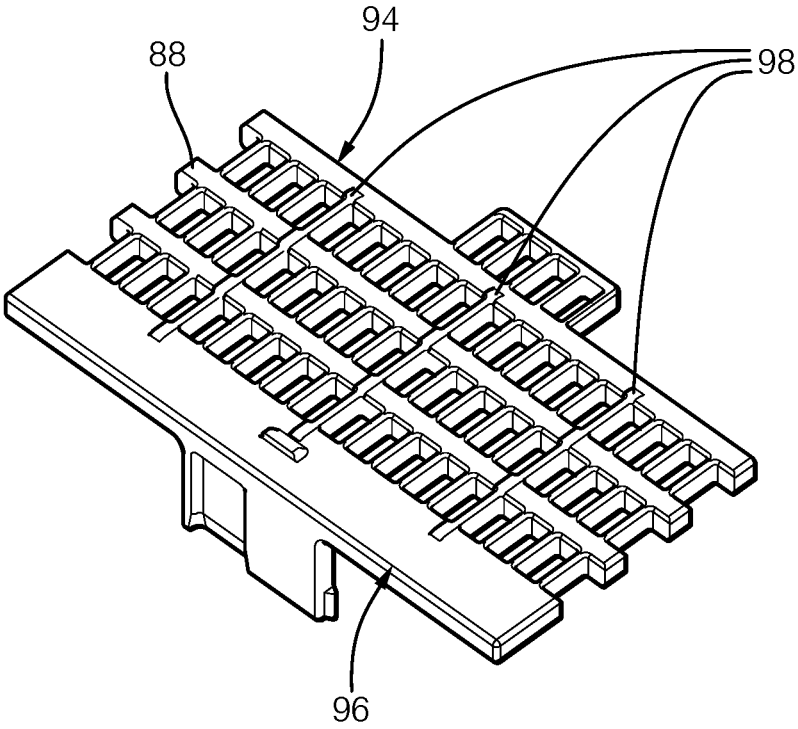
FIG. 9B is an illustration of the intermediate-secondary-lock of FIG. 9A rotated 180 degrees.

FIGS. 9A-9B illustrate the ISL 88 isolated from the inner-housing-assembly 62 from two perspectives and show the pressure-pads 98. In one embodiment, the pressure-pads 98 are located on the leading-edge 94 of the ISL 88. In another embodiment, the pressure-pads 98 are distributed across the ISL 88.

While this invention has been described in terms of the preferred embodiments thereof, it is not intended to be so limited, but rather only to the extent set forth in the claims that follow. "One or more" includes a function being performed by one element, a function being performed by more than one element, e.g., in a distributed fashion, several functions being performed by one element, several functions being performed by several elements, or any combination of the above. It will also be understood that, although the terms first, second, etc. are, in some instances, used herein to describe various elements, these elements should not be limited by these terms. These terms are only used to distinguish one element from another. For example, a first contact could be termed a second contact, and, similarly, a second contact could be termed a first contact, without departing from the scope of the various described embodiments. The first contact and the second contact are both contacts, but they are not the same contact. The terminology used in the description of the various described embodiments herein is for the purpose of describing particular embodiments only and is not intended to be limiting. As used in the description of the various described embodiments and the appended claims, the singular forms "a", "an" and "the" are intended to include the plural forms as well, unless the context clearly indicates otherwise. It will also be understood that the term "and/or" as used herein refers to and encompasses any and all possible combinations of one or more of the associated listed items. It will be further understood that the terms "includes," "including," "comprises," and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "if" is, optionally, construed to mean "when" or "upon" or "in response to determining" or "in response to detecting," depending on the context. Similarly, the phrase "if it is determined" or "if [a stated condition or event] is detected" is, optionally, construed to mean "upon determining" or "in response to determining" or "upon detecting [the stated condition or event]" or "in response to detecting [the stated condition or event]," depending on the context. Directional terms such as top, bottom, upper, lower, left, right, front, rear, etc. do not denote any particular orientation, but rather these directional terms are used to distinguish one element from another and establish a relationship between the various elements.

We claim:

1. An electrical connector-assembly, comprising:

a first-housing having first-walls aligned parallel to a mating-axis of the assembly, wherein the first-walls include opposed gear-racks extending beyond an outer-surface of the first-walls along a lateral-axis and aligned with the mating-axis, wherein the opposed gear-racks are configured to engage a mate-assist device, wherein the first-walls include opposed locking-fins extending along a longitudinal-axis beyond the outer-surface and aligned with the mating-axis, and wherein the opposed locking-fins having first-fins and second-fins are aligned with the mating-axis;

a second-housing including the mate-assist device which is moveable from an unlocked-position to a locked-position, wherein the mate-assist device is pivotable about the lateral-axis, wherein the mate-assist device has gear-teeth configured to engage the opposed gear-racks of the first-housing, wherein the second-housing has a skirt aligned with the mating-axis, wherein the skirt is configured to slideably engage the outer-surface of the first-housing, wherein the skirt defines opposed-apertures aligned with the longitudinal-axis, wherein the skirt includes flex-locks disposed within the opposed-apertures extending along the mating-axis, wherein the flex-locks are configured to engage the first-fins and retain the second-housing in a prestaged-position, and wherein, the second-housing is moved from the prestaged-position to a seated-position when the mate-assist device is moved from the unlocked-position to the locked-position, whereby the flex-locks engage the second-fins, thereby inhibiting a movement between the second-housing and the first-housing; and an inner-housing-assembly, comprising:

a base configured to retain connector-ends of a plurality of corresponding electrical-terminals housed within the assembly, wherein the base includes second-walls extending along the mating-axis of the assembly, wherein the second-walls define a first-slot and a second-slot opposite the first-slot, wherein the first-slot and the second-slot extend along the longitudinal-axis of the assembly, and wherein the first-slot is longer than the second slot;

a terminal-lock overlying the base configured to releasably lock the plurality of corresponding electrical-terminals within the base;

a crimp-housing configured to retain crimp-ends of the plurality of corresponding electrical-terminals within crimp-cavities defined by the crimp-housing, the crimp-housing overlying the terminal-lock, wherein the crimp-housing defining a passage extending along both the lateral-axis and the longitudinal-axis, wherein the passage is disposed between the first-slot and the second-slot; and an intermediate-secondary-lock slideably disposed within the passage, wherein the intermediate-secondary-lock is moveable from a first-position to a second-position along the lateral-axis, wherein the intermediate-secondary-lock is configured to inhibit the movement of the plurality of corresponding electrical-terminals along the mating-axis when moved to the second-position, wherein the intermediate-secondary-lock has a leading-edge and a trailing-edge opposite the leading-edge, and wherein when the intermediate-secondary-lock is moved to the second-position, a portion of the leading-edge is disposed within the second-slot, thereby interlocking the base with the crimp-housing at both the first-slot and the second-slot.

2. The assembly in accordance with claim 1, wherein a force of between about 10 Newtons and about 15 Newtons is required to remove the second-housing from the first-housing when the second-housing is in the prestaged-position.

3. The assembly in accordance with claim 1, wherein the first-housing further includes a plurality of opposed first-fin and second-fin pairs and the second-housing further includes a plurality of corresponding flex-locks.

4. The assembly in accordance with claim 1, wherein the first-fins and the second-fins define first-angles and second-angles, the first-angles less than the second-angles.

5. The assembly in accordance with claim 4, wherein the first-angles are in a range between 15 degrees and 30 degrees and the second-angles are in the range between 30 degrees and 60 degrees.

6. The assembly in accordance with claim 1, wherein a parallelism between the first-housing and the second-housing relative to a plane parallel with the longitudinal-axis is less than 0.01 mm when the flex-locks engage the second-fins.

7. The assembly in accordance with claim 1, wherein the first-housing is configured to retain electrical-terminals and the second-housing configured to retain corresponding electrical-terminals configured to mate with the electrical-terminals of the first-housing.

8. The assembly in accordance with claim 1, wherein a plurality of pressure-pads on the leading-edge of the intermediate-secondary-lock create a transition-fit when the intermediate-secondary-lock is moved to the second-position, thereby inhibiting the movement between the base, the terminal-lock, the crimp-housing.

9. The assembly in accordance with claim 1, wherein the terminal-lock includes a plurality of cantilevered locking-arms configured to releasably lock the plurality of corresponding electrical-terminals within the base, and wherein the plurality of cantilevered locking-arms are disposed within terminal-cavities defined by the base and extending along the mating-axis.

10. An inner-housing-assembly, comprising:

a base configured to retain connector-ends of a plurality of corresponding electrical-terminals housed within a connector-assembly, wherein the base includes second-walls extending along a mating-axis of the connector-assembly, wherein the second-walls define a first-slot and a second-slot opposite the first-slot, wherein the first-slot and the second-slot extend along a longitudinal-axis of the connector-assembly, and wherein the first-slot is longer than the second slot;

a terminal-lock overlying the base configured to releasably lock the plurality of corresponding electrical-terminals within the base;

a crimp-housing configured to retain crimp-ends of the plurality of corresponding electrical-terminals within crimp-cavities defined by the crimp-housing, the crimp-housing overlying the terminal-lock, wherein the crimp-housing defining a passage extending along both a lateral-axis and the longitudinal-axis, wherein the passage is disposed between the first-slot and the second-slot; and an intermediate-secondary-lock slideably disposed within the passage, wherein the intermediate-secondary-lock is moveable from a first-position to a second-position along the lateral-axis, wherein the intermediate-secondary-lock is configured to inhibit a movement of the plurality of corresponding electrical-terminals along the mating-axis when moved to the second-position, wherein the intermediate-secondary-lock has a leading-edge and a trailing-edge opposite the leading-edge, and wherein when the intermediate-secondary-lock is moved to the second-position, a portion of the leading-edge is disposed within the second-slot, thereby interlocking the base with the crimp-housing at both the first-slot and the second-slot.

11. The inner-housing-assembly in accordance with claim 10, wherein the base includes a plurality of locking-fingers extending inward from the second-walls, the plurality of locking-fingers configured to retain the crimp-housing and inhibit a disassembly of the inner-housing-assembly.

12. The inner-housing-assembly in accordance with claim 10, wherein the trailing-edge of the intermediate-secondary-lock is disposed within the first-slot when the intermediate-secondary-lock is in the first-position.

13. An inner-housing-assembly comprising:

a base configured to retain connector-ends of a plurality of corresponding electrical-terminals housed within the assembly, wherein the base includes second-walls extending along the mating-axis of the assembly, wherein the second-walls define a first-slot and a second-slot opposite the first-slot, and wherein the first-slot and the second-slot extend along the longitudinal-axis of the assembly;

a terminal-lock overlying the base configured to releasably lock the plurality of corresponding electrical-terminals within the base;

a crimp-housing configured to retain crimp-ends of the plurality of corresponding electrical-terminals within crimp-cavities defined by the crimp-housing, the crimp-housing overlying the terminal-lock, wherein the crimp-housing defining a passage extending along both the lateral-axis and the longitudinal-axis, wherein the passage is disposed between the first-slot and the second-slot; and an intermediate-secondary-lock slideably disposed within the passage, wherein the intermediate-secondary-lock is moveable from a first-position to a second-position along the lateral-axis, wherein the intermediate-secondary-lock is configured to inhibit the movement of the plurality of corresponding electrical-terminals along the mating-axis when moved to the second-position, wherein the intermediate-secondary-lock has a leading-edge and a trailing-edge opposite the leading-edge, wherein when the intermediate-secondary-lock is moved to the second-position, a portion of the leading-edge is disposed within the second-slot, thereby interlocking the base with the crimp-housing at both the first-slot and the second-slot, and wherein a plurality of pressure-pads on the leading-edge of the intermediate-secondary-lock create a transition-fit when the intermediate-secondary-lock is moved to the second-position, thereby inhibiting the movement between the base, the terminal-lock, the crimp-housing.

14. An inner-housing-assembly, comprising:

a base configured to retain connector-ends of a plurality of corresponding electrical-terminals housed within the assembly, wherein the base includes second-walls extending along the mating-axis of the assembly, wherein the second-walls define a first-slot and a second-slot opposite the first-slot, and wherein the first-slot and the second-slot extend along the longitudinal-axis of the assembly;

a terminal-lock overlying the base configured to releasably lock the plurality of corresponding electrical-terminals within the base;

a crimp-housing configured to retain crimp-ends of the plurality of corresponding electrical-terminals within crimp-cavities defined by the crimp-housing, the crimp-housing overlying the terminal-lock, wherein the crimp-housing defining a passage extending along both the lateral-axis and the longitudinal-axis, wherein the passage is disposed between the first-slot and the second-slot; and an intermediate-secondary-lock slideably disposed within the passage, wherein the intermediate-secondary-lock is moveable from a first-position to a second-position along the lateral-axis, wherein the intermediate-secondary-lock is configured to inhibit the movement of the plurality of corresponding electrical-terminals along the mating-axis when moved to the second-position, wherein the intermediate-secondary-lock has a leading-edge and a trailing-edge opposite the leading-edge, wherein when the intermediate-secondary-lock is moved to the second-position, a portion of the leading-edge is disposed within the second-slot, thereby interlocking the base with the crimp-housing at both the first-slot and the second-slot, wherein the terminal-lock includes a plurality of cantilevered locking-arms configured to releasably lock the plurality of corresponding electrical-terminals within the base, and wherein the plurality of cantilevered locking-arms are disposed within terminal-cavities defined by the base and extending along the mating-axis.

15. The inner-housing-assembly in accordance with claim 14, wherein the terminal-lock includes electrical-isolation-walls that inhibit an overtravel of the plurality of cantilevered locking-arms and further increase an electrical-isolation between the plurality of corresponding electrical-terminals.

* * * * *